US005577520A

United States Patent [19]

Sluder

[11] Patent Number: 5,577,520

[45] Date of Patent: Nov. 26, 1996

[54] HAIR CUTTING AID

[76] Inventor: Tanya Sluder, 3524 Bremond, Amarillo, Tex. 79109

[21] Appl. No.: 373,569

[22] Filed: Jan. 17, 1995

[51] Int. Cl.[6] ..... A45D 24/36

[52] U.S. Cl. ..... 132/214; 2/12; 2/174

[58] Field of Search ..... 132/214, 213, 132/275; 2/174, 12; D28/10, 44

[56] References Cited

U.S. PATENT DOCUMENTS

| | | | |
|---|---|---|---|
| D. 330,270 | 10/1992 | Awan . | |
| 704,311 | 7/1902 | Galley | 2/174 |
| 1,283,358 | 10/1918 | Thompson | 2/174 |
| 2,539,198 | 1/1951 | Metzler | 132/214 |
| 2,936,767 | 5/1960 | McDonough | 132/214 |
| 3,935,870 | 2/1976 | Wall . | |
| 3,972,075 | 8/1976 | Alevras . | |
| 4,137,925 | 2/1979 | Castillo . | |
| 4,481,680 | 11/1984 | Mason et al. | 2/174 |
| 4,619,280 | 10/1986 | Yampolskaya . | |
| 4,689,830 | 9/1987 | Williams . | |

FOREIGN PATENT DOCUMENTS

| | | | |
|---|---|---|---|
| 2298434 | 7/1982 | France | 132/214 |

*Primary Examiner*—Todd E. Manahan
*Attorney, Agent, or Firm*—Norman B. Rainer

[57] ABSTRACT

A device for expediting the uniform cutting of a person's hair and catching the resultant hair clippings has a cap-like construction having an encircling headband and a forwardly directed brim. The headband has size-adjusting rear portions and straight line indicia which provide guidance to the operator during cutting. The brim has an upturned lip for retaining clippings.

4 Claims, 3 Drawing Sheets

HAIR CUTTING AID

BACKGROUND OF THE INVENTION

1. Field of the Invention

This invention pertains to means for assisting in the cutting of hair, and more particularly concerns a device for expediting the uniform cutting of hair and catching of resultant hair clippings.

2. Description of the Prior Art

Various devices have earlier been disclosed for use by hair stylists in the cutting of a client's hair. For example, devices having aperture or template means through which hair is drawn prior to cutting are disclosed in U.S. Pat. Nos.: D 330,270; 4,619,280; and 3,972,075. Devices having adjustable members which guide the movement of scissors in arcuate paths are disclosed in U.S. Pat. Nos. 3,935,870 and 4,137,925. U.S. Pat. No. 4,689,830 discloses a hair cutting cape for receiving hair clippings but does not aid in the cutting of the hair.

Of the aforesaid devices, only the device of U.S. Pat. No. 4,137,925 to Castillo is useful for the precision cutting of hair adjacent the forehead region, as in producing a hair style known as "bangs" wherein hair is forwardly combed, downwardly directed, and cut along a substantially horizontal line. The Castillo device, however, is of complex construction, difficult to utilize, and uncomfortable for the client. Adjustability of the Castillo device to accommodate different head sizes and/or hair styles requires the manipulation of four wing nuts.

The bangs hairstyle is very popular. However, securement of proper aesthetic effect is dependent upon well executed cutting performance. In particular, it is necessary that the lowermost extremity of the bangs hair line be uniform, straight, horizontal and at the proper height. Practical means for expediting or achieving proper bangs haircutting would clearly be welcomed by both hairstylists and those individuals who cut their own hair. In the cutting of bangs, the hair clippings are particularly bothersome because they fall upon the person's face.

It is accordingly an object of the present invention to provide a device for aiding in haircutting to form bangs.

It is another object of this invention to provide a device as in the foregoing object which additionally catches hair clippings.

It is a further object of the present invention to provide a device of the aforesaid nature which is easily adjustable to accommodate different head sizes.

It is a still further object of this invention to provide a device of the aforesaid nature which is easy to use and of durable, simple construction amenable to low cost manufacture.

These and other beneficial objects and advantages will be apparent from the following description.

SUMMARY OF THE INVENTION

The above and other beneficial objects and advantages are accomplished in accordance with the present invention by a haircutting assisting device comprising:

a) a headband of flat contour defined in part by substantially straight upper and lower edges and elongated in a circuitous path between two compliant rear portions terminating in extremities configured to overlap each other, thereby defining an adjustment region, quick-acting releasible securing means associated with said rear portions in said adjustment region, and a substantially rigid front portion which bears visibly distinctive indicia in the form of at least one straight guide line horizontally disposed in the direction of elongation of said headband, b) a substantially rigid brim forwardly and substantially horizontally emergent from the lower edge of said headband along said front portion, and bounded by an arcuate edge, and c) a retaining lip upraised from said brim along said arcuate edge.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
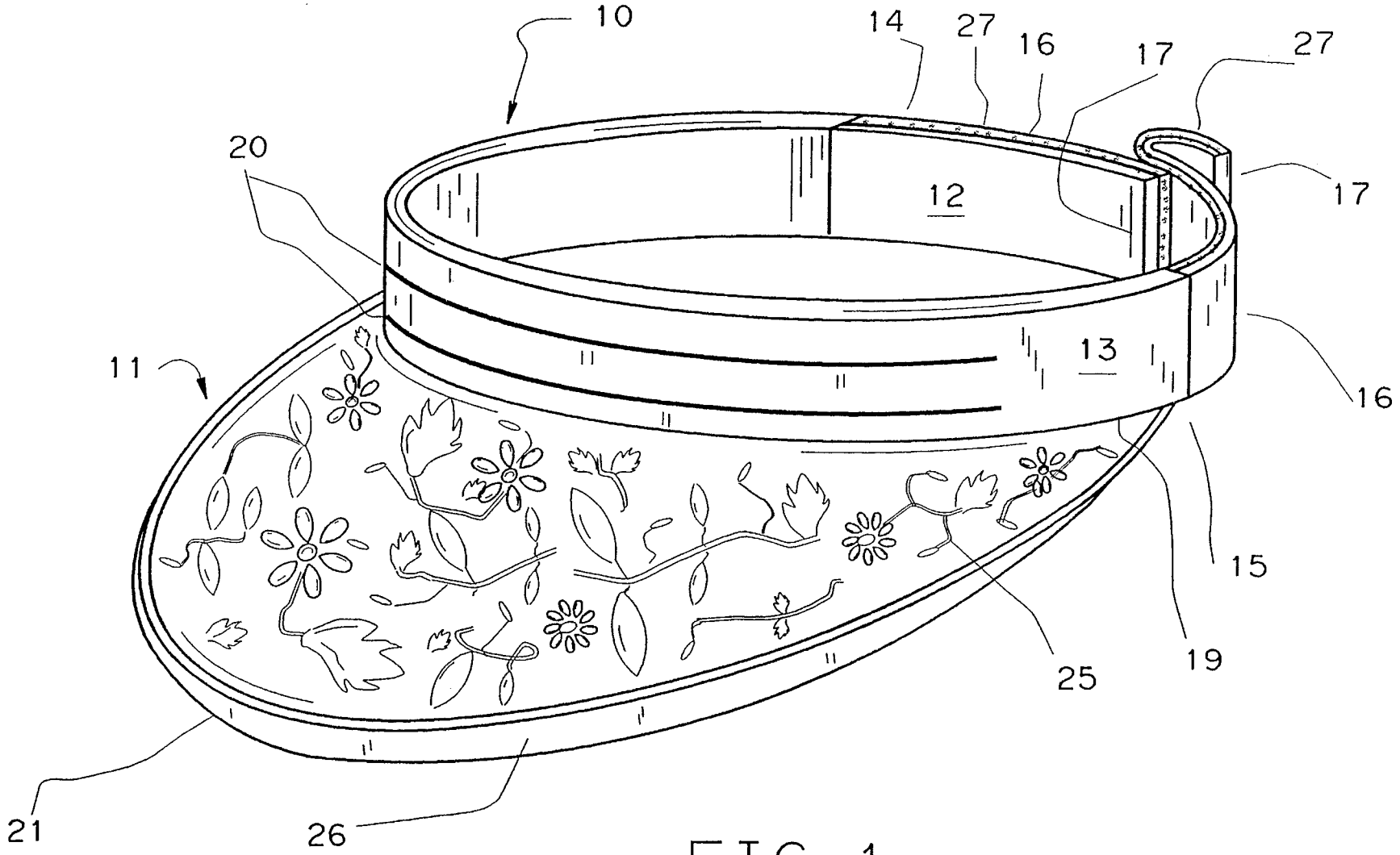
FIG. 1 is a perspective view of an embodiment of the haircutting assisting device of the present invention.
Figure 2:
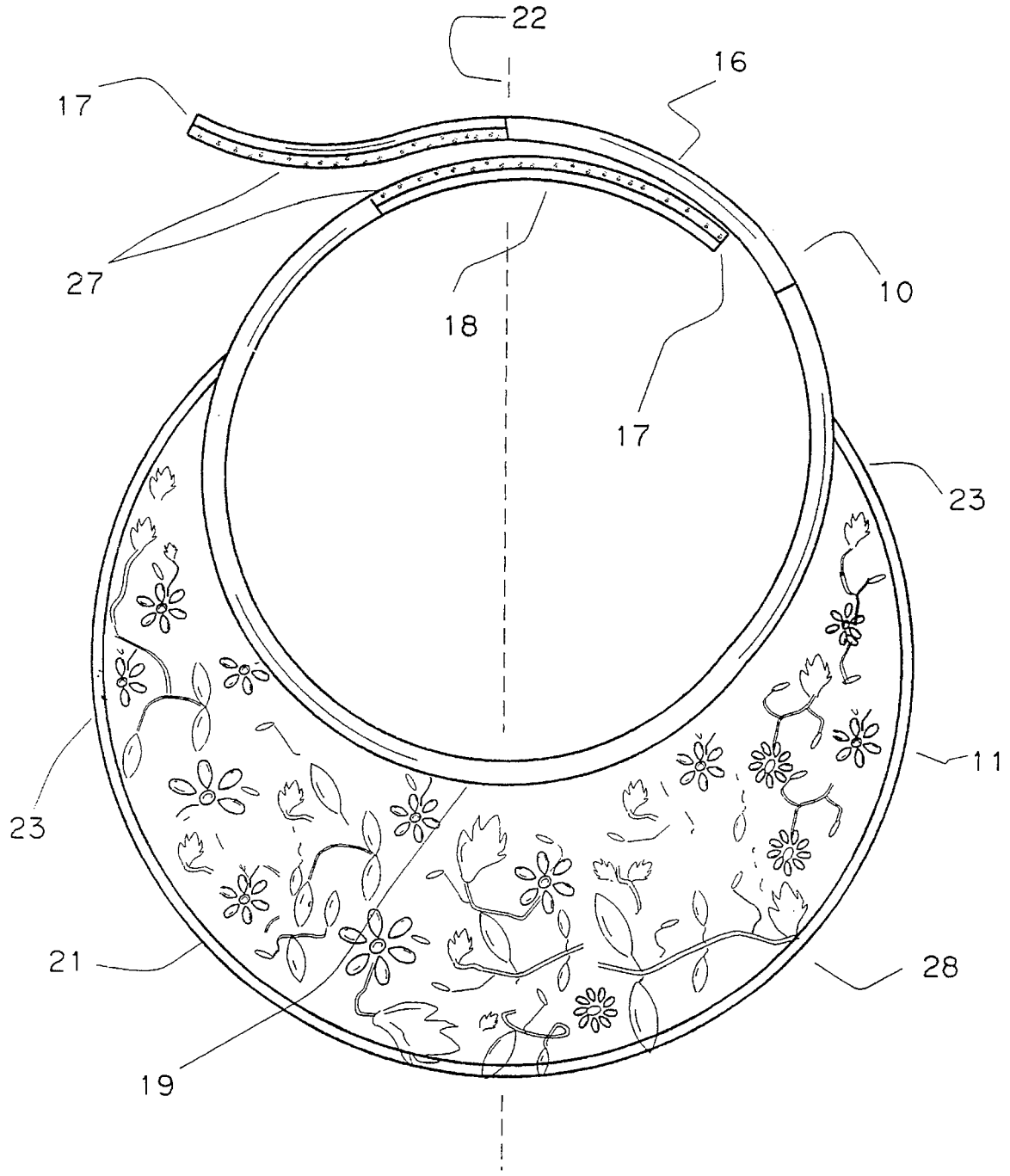
FIG. 2 is a top plan view of the device.
Figure 3:
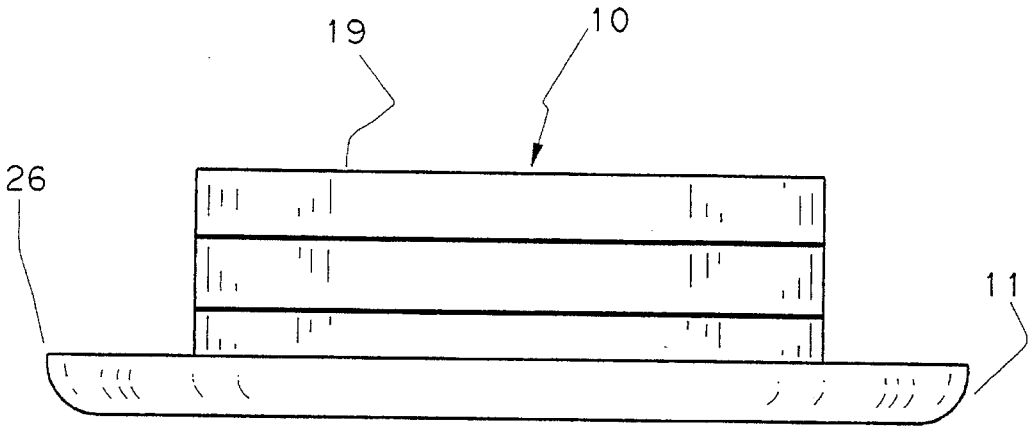
FIG. 3 is a front view.
Figure 4:
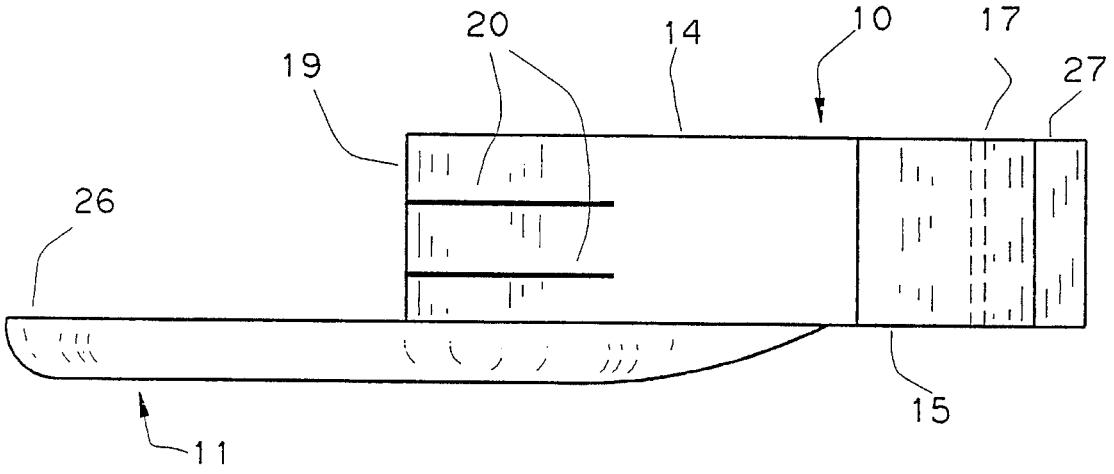
FIG. 4 is a side view.

Referring to FIGS. 1–4, an embodiment of the haircutting assisting device of the present invention is shown comprised of headband 10 and attached brim 11. Headband 10 is of substantially flat contour, defined by interior and exterior surfaces, 12 and 13, respectively, and substantially straight upper and lower edges 14 and 15, respectively. The headband is elongated in a circuitous path between two flexible rear strap portions 16 which terminate in extremities 17 configured to overlap each other, thereby defining an adjustment region 18. Quick-acting releasible securing means are associated with said rear strap portions within adjustment region 18. Preferred securing means are interactive pieces of hook and loop fastening material 27 disposed upon the interior surface of one rear portion and upon the exterior surface of the opposing rear portion. Other securing means, such as snap fasteners, may also be effective in achieving the sought easy and secure interengagement of the rear strap portions whereby adjustment of the effective diameter of the closed headband is achieved.

Suitable hook and loop type attachment material is commercially available under the trademark VELCRO from the Velcro Corporation of N.Y. Such hook and loop attachment or fastening material are paired interactive members, each comprising a compliant base sheet having an upraised pile of synthetic fibers. The fibers of one member are in the form of loops. The fibers of the other interactive member are cut loops, which constitute hooks. When the two members of the fastening system are pressed together in face-to-face relationship, there is substantial engagement of hook fibers with loop fibers. A considerable effort must be applied to separate the members unless they are peeled apart, in which event the members are easily separated.

The front portion 19 of headband 10 is of bendable, semi-rigid construction. The entire headband may be of monolithic construction, fabricated of plastic wherein said front portion is rendered more rigid than rear portions 16 by virtue of a greater thickness of the plastic material. Alternatively, the headband may be fabricated from separate components, wherein a stiffer material is utilized for the front portion than for the rear portions. The height of headband 10, measured orthogonally between said upper and lower edge may range between about ¾" and 1-½". Although the height may be uniform throughout headband 10, the rear portions may in some embodiments be less than the height of the front portion. Said front portion may occupy 200 degrees of circular angle of the circuitous path of the headband.

Visibly distinctive measuring indicia 20 are disposed upon exterior surface 13 of front portion 19, the effect of said indicia being to provide at least one horizontal reference line to guide the operator in the cutting of hair. The indicia may be printed, embossed, punched holes or of other nature, and may be a continuous line, broken line or non-straight array having a straight center axis. The indicia preferably provide at least two horizontal straight line paths, spaced one above the other.

Brim 11 is of bendable semi-rigid construction and extends forwardly and substantially horizontally from lower edge 15 of front portion 19 of said headband. Said brim is defined by an arcuate border edge 21. The width of brim 11, measured orthogonally between front portion 19 and border edge 21 may be between about 2 and 3 inches at the center axis 22 of the headband, but will taper to smaller widths at both lateral extremities 23. The upper surface 25 of said brim may be provided with decorative indicia 28.

A retaining lip 26 is upraised from said brim along arcuate border edge 21. The height of the lip may range from about ¼" to ½". The purpose of the lip is to catch and retain hair clippings, thereby preventing said clippings from falling into the person's face. The lip may be of wall-like construction, or may merely be an upwardly curved contour of border edge 21 of the brim. In either construction, the lip is preferably a continuous integral extension of the brim. In alternative embodiments however, the lip may be constructed from a separate piece which is secured to the brim.

In use, the operator, which may be the person cutting her own hair, combs her front hair straight forwardly and downwardly over the brim. Employing scissors, the downwardly directed hair is cut along a desired line of indicia on the front portion of the headband. Hair which falls as a result of such cutting will be caught by the brim, or otherwise deflected away from the person's face.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A haircutting assisting device comprising:

a) a headband of flat contour elongated in a circuitous planar path and defined in part by substantially parallel straight upper and lower edges, and opposed interior and exterior surfaces, said headband having: 1) a front portion bearing visibly distinctive indicia on said exterior surface in the form of at least one straight guide line in parallel disposition to said upper and lower edges, 2) two flexible rear portions which terminate in extremities configured to overlap each other within the plane of said circuitous path and thereby define an adjustment region, and 3) quick-acting releasible securing means associated with said rear portions in said adjustment region, said headband being of monolithic construction, fabricated of plastic wherein said front portion is rendered more rigid than said rear portion by virtue of a greater thickness of the plastic material, b) a substantially rigid brim forwardly and substantially horizontally emergent from said lower edge and bounded by a forward arcuate edge, and c) a retaining lip upraised from said brim along said arcuate edge as a continuous integral extension of said brim.

2. The device of claim 1 wherein said securing means is hook and loop fastening material disposed upon the interior surface of one rear portion and upon the exterior surface of the opposing rear portion.

3. The device of claim 1 wherein said visibly distinctive indicia is comprised of at least two parallel straight lines.

4. The device of claim 3 wherein said brim is bounded by a lower surface and an upper surface provided with decorative indicia.

* * * * *